US008251200B2

(12) United States Patent
Lunardi et al.

(10) Patent No.: US 8,251,200 B2
(45) Date of Patent: Aug. 28, 2012

(54) STEPS OR PLATES FOR A CONVEYING DEVICE, AND CONVEYING DEVICE

(75) Inventors: Gerhard Lunardi, Österreich (AT); Michael Matheisl, Österreich (AT); Thomas Novacek, Österreich (AT); Harald Gössl, Österreich (AT)

(73) Assignee: Inventio AG, Hergiswil NW (CH)

( * ) Notice: Subject to any disclaimer, the term of this patent is extended or adjusted under 35 U.S.C. 154(b) by 127 days.

(21) Appl. No.: 12/680,765

(22) PCT Filed: Sep. 26, 2008

(86) PCT No.: PCT/EP2008/062968

§ 371 (c)(1), (2), (4) Date: Mar. 30, 2010

(87) PCT Pub. No.: WO2009/047145

PCT Pub. Date: Apr. 16, 2009

(65) Prior Publication Data

US 2010/0206691 A1 Aug. 19, 2010

(30) Foreign Application Priority Data

Oct. 1, 2007 (EP) ..... 07117644

(51) Int. Cl.
*B66B 23/12* (2006.01)

(52) U.S. Cl. ..... 198/333; 198/327

(58) Field of Classification Search ..... 198/326–333
See application file for complete search history.

(56) References Cited

U.S. PATENT DOCUMENTS

| | | | | | |
|---|---|---|---|---|---|
| 617,788 | A * | 1/1899 | Wheeler | 198/325 |
| 2,033,308 | A * | 3/1936 | Shonnard | 198/332 |
| 4,295,556 | A * | 10/1981 | Saito et al. | 198/325 |
| 4,483,432 | A * | 11/1984 | Ishida | 198/333 |
| 4,984,673 | A * | 1/1991 | Saito et al. | 198/333 |
| 5,785,167 | A * | 7/1998 | Rugg | 198/333 |
| 5,988,350 | A * | 11/1999 | Nusime et al. | 198/333 |
| 6,543,599 | B2 * | 4/2003 | Jasinetzky | 198/333 |
| 6,978,876 | B1 * | 12/2005 | Tsukahara et al. | 198/333 |
| 7,232,028 | B2 * | 6/2007 | Schulz | 198/493 |
| 7,841,460 | B2 * | 11/2010 | Streibig et al. | 198/333 |
| 7,857,115 | B2 * | 12/2010 | LeBrecque et al. | 198/326 |
| 2002/0074211 | A1 * | 6/2002 | Jasinetzky | 198/333 |

FOREIGN PATENT DOCUMENTS

| | | | |
|---|---|---|---|
| DE | 69 443 | A | 10/1969 |
| JP | 01 308388 | A | 12/1989 |
| JP | 08 245152 | A | 9/1996 |
| JP | 2004 292106 | | 10/2004 |

* cited by examiner

*Primary Examiner* — Mark A Deuble
(74) *Attorney, Agent, or Firm* — Ladas & Parry LLP

(57) ABSTRACT

Step cheek (20.1, 20.2) for a conveying device (1) having a plurality of steps (2) or plates, wherein each step (2) or plate has two lateral step cheeks (20.1, 20.2) which stand substantially perpendicular with respect to a tread element (9) and a seating element (14) of the step (2) or plate. The step cheek (20.1, 20.2) comprises a single-piece, deep-drawn metal sheet, wherein the metal sheet has a three-dimensional shape with an at least partially circumferential rim (26) and a step socket (32) which is enclosed or surrounded by the metal sheet.

12 Claims, 4 Drawing Sheets

STEPS OR PLATES FOR A CONVEYING DEVICE, AND CONVEYING DEVICE

The invention relates to steps or plates with special step cheeks, or cheeks, for conveying devices, and to conveying devices with such steps or plates.

BACKGROUND OF THE INVENTION

Conveying devices in the sense of the invention, which can also be termed transport devices, are escalators and moving walkways with a plurality of tread units or moving walkway plates, which are connected to form an endless conveyor. Users of the conveying devices stand on tread surfaces of the tread units or walk on the tread units in the same direction of movement as the conveying devices move or progress.

In the case of escalators, the tread units form escalator steps, hereinafter termed steps, and in the case of moving walkways the tread units form moving walkway plates, hereinafter termed plates. Escalators bridge, with a relatively large angle of inclination, greater distances in height such as entire storeys. Thereagainst, moving walkways run horizontally or at a slight inclination, but in general with smaller angles of inclination than escalators.

Typically, such conveying devices comprise drive runs constructed as step chains or plate chains. For the sake of simplicity merely drive runs are referred to in the following. These drive runs are driven in order to move the steps or plates in a transport direction and, in accordance with the state of the art, they are provided at uniform spacings with so-termed guide rollers. These guide rollers move or roll along dedicated or provided guide rails. In the region of the ends of the conveying devices the drive trains run, by the guide rollers, around deflecting wheels (for example chain wheels) and thus execute a change in direction. Slide elements can also be used instead of guide rollers or drag rollers. The slide elements or the rollable elements (guide rollers or chain rollers) are directly fastened to a step chain or plate chain serving as drive run, as described further above.

In addition to the step chains or plate chains inclusive of the slide elements or rollable elements fastened thereto two further rollers, which are termed drag rollers and roll or move along separate guide rails, are required for each step or plate.

The steps or plates have in the past been relatively complicated to produce or cast and are also expensive, since they have to be intrinsically very stable and torsionally stiff. Moreover, the steps or plates have to be made with a high degree of accuracy in order to guarantee quiet, jerk-free running. An essential element of the steps or plates is the lateral cheeks or step cheeks which have a significant supporting function. Hitherto, step cheeks or cheeks were typically made of aluminium, which did indeed lead to a low weight, but was accompanied by high costs, since the casting moulds or die-casting moulds were very expensive. Alternatively, use was made of step cheeks or cheeks screwed together from several different sheet metal parts and different cast or moulded parts. These step cheeks or cheeks were usually approximately twice as heavy as an aluminium (step) cheek.

JP 2004/292106 A describes a step, which has side cheeks, for a conveying device. These cheeks have a three-dimensional shape with a partly encircling flange. The features of a pair of lateral step cheeks substantially perpendicular to a tread element can thus be inferred from this specification. By contrast to FIG. 1, in FIGS. 7 and 12 of this specification there can be seen in the side cheeks a circle which can be interpreted as a cheek eye. However, this circle is not designated, and not clarified in the description. The position of the circle in any case excludes the possibility of a chain pin axle being mounted there.

JP 01308388 A or GB 2216825 A equivalent thereto shows in FIG. 1 a step with side cheeks which have a two-dimensional form and are constructed without an encircling edge. These side cheeks, which are formed from thick material, mount chain pin axles and drag roller axles in a usual manner. Side cheeks can be seen in FIG. 18, which are formed from thin sheet metal with a partly encircling edge. However, these side cheeks do not have eyes which could serve for the mounting of chain pin axles or drag roller axles. These axles are obviously mounted on more stable components which have to be connected with these cheeks.

DD 69443 relates to a step for escalators in which side cheeks are integrally connected with a front part. The front part is then covered by a riser element. A tread element covering the step has an angled portion which closes off the step at the side opposite the riser element. In that case the front part and the cheeks are of a flat construction, in which also no eyes for reception of angles are provided. Here, too, presumably the axles are mounted in more stable components which have to be connected with the cheeks.

The wish exists, particularly for more economic initial equipping of conveying devices, to replace the steps and plates by more advantageous components without in that case, however, impairing running smoothness, travel characteristics, stability, robustness and reliability as well as durability. Moreover, the production process should be simplified and accelerated.

BRIEF DESCRIPTION OF THE INVENTION

It is therefore the object of the invention

- to create a more economic step cheek or cheek for a step or plate of the kind stated in the introduction, which, however, nevertheless satisfies all demands or demand profiles and enables quiet, jerk-free running, is not susceptible to failure and guarantees a long running time or high service life; in addition, cheeks or step cheeks shall not be significantly heavier than current aluminium (step) cheeks;
- to create a more economic conveying device of the kind stated in the introduction, which makes quiet, jerk-free running possible, is not susceptible to failure and guarantees a high service life or long running time.

According to the invention step cheeks or cheeks are specially designed for use in a conveying device having several steps or plates, wherein each step or plate has two lateral step cheeks or, cheeks which are substantially perpendicular to a tread element or a tread surface and, in the case of a step, also to a riser element or a riser surface or riser step. Middle step cheeks or cheeks can obviously also be provided between the two lateral step cheeks or cheeks. The step cheek or cheek consists of an integral deep-drawn metal sheet, wherein the metal sheet has a three-dimensional form with an at least partly encircling flange. Moreover, the step cheek or cheek has a step eye or plate eye which is formed by deep-drawing. In addition, the step eye or plate eye of the step cheek or cheek is enclosed or surrounded by the sheet metal or steel sheet or stainless steel sheet. The step cheek or cheek comprises with the step eye or plate eye a chain pin axle of a chain or conveyor chain.

A transport device according to the invention has at least one step or plate of that kind.

Unexpectedly it was discovered within the scope of the present invention that a deep-drawn eye is sufficiently stable in order to be able to directly accommodate therein the bearing for the chain pin axle. Production is thereby obviously very substantially simplified, but the step cheek or cheek can still be produced from a single part by deep-drawing. When it is considered that the entire driving force is transmitted by way of these chain pin axles this is in no way obvious. In a given case the eye can be reinforced by an edge plate, but this is still substantially simpler than mounting the axle in an additional, stable and thus heavy component, which then has to be fixedly connected with the cheek.

It is particularly surprising that this is possible even when the chain pin axle is a chain pin plug axle or the chain pin axles are not continuous over the entire width of the escalator or the moving walkway. In this case, in particular, not only the propelling forces, but also even quite substantial torsional forces act on the cheek eyes, yet the cheek eyes clearly lie within the two drive runs.

Preferred developments of the step cheek or cheek according to the invention and the conveying device include that the chain pin axle is a chain pin plug axle; that the chain pin axle is not continuous over the width of the conveying device; and that an encircling sheet metal collar is present in the region of the step or plate eye. In particular, it is to be mentioned that it is obviously advantageous to also fasten the drag roller axles in an analogous manner.

BRIEF DESCRIPTION OF THE DRAWINGS

The invention is explained in the following by way of examples and with reference to the drawing, in which:

FIG. 5C shows a perspective view of the deep-drawn sheet metal of a step cheek according to the invention, from the inside, after elements of the step cheek have been welded on.

DETAILED DESCRIPTION OF THE INVENTION

Figure 1:
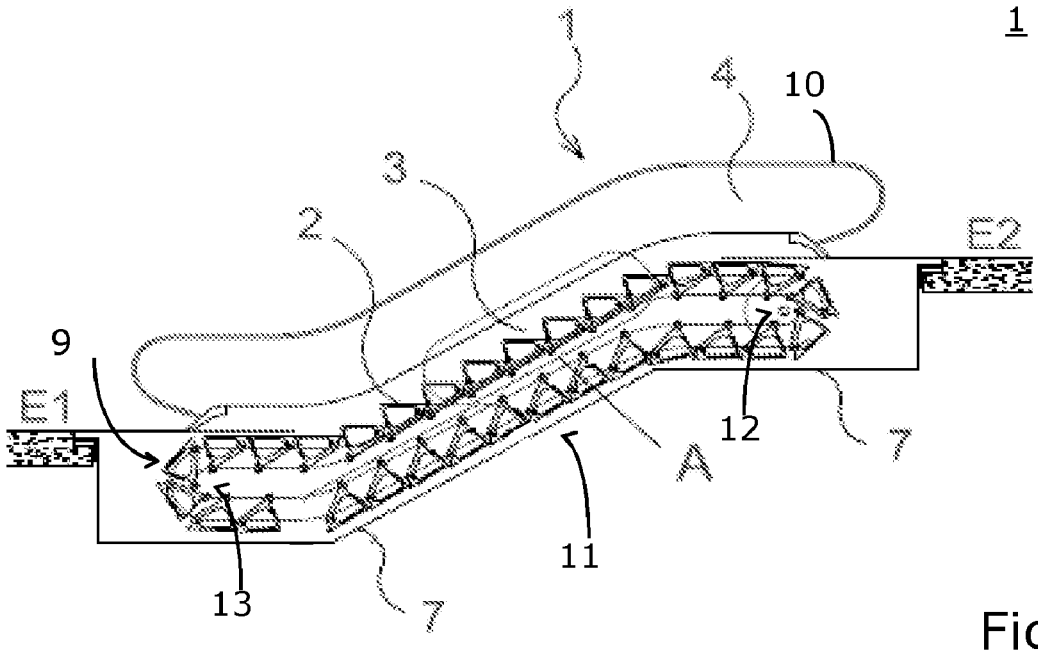
FIG. 1 shows a conveying device in the form of an escalator, in a side view, partly sectioned.

The conveying device 1 illustrated in FIG. 1 is an escalator which connects a lower level 1 with an upper level E2. The conveying device 1 comprises lateral balustrades 4 and base plates 3 and an endless conveyor with drive runs. Typically, two conveyor chains or step chains, which extend parallel to one another, with chain rollers are used as drive runs in order to set the steps 2 in motion.

In addition, an endless handrail 10 is provided. The handrail 10 moves in fixed relationship or with a slight lead with respect to the drive runs or chain runs and the steps 2 or plates. The support structure or chassis is denoted by the reference numeral 7 and the base plate of the conveying device 1 is denoted by the reference numeral 3.

The endless conveyor of the conveying device 1 substantially comprises a plurality of tread units (steps 2), as well as the two laterally arranged drive runs or step chains, between which the steps 2 are arranged and with which the steps 2 are mechanically connected. Additionally and further the endless conveyor comprises a drive (not illustrated) as well as upper deflecting means 12 and lower deflecting means 13, which are disposed in the upper end region and lower end region, respectively, of the conveying device 1. The steps 2 have tread elements 9 (tread surfaces).

As indicated in FIG. 1, the steps 2 run from the lower deflecting means 13, which is disposed in the region of the lower level E1, obliquely upwardly to the upper deflecting means 12, which is disposed in the region of the upper level E2. This region leading from the lower deflecting means 13 to the upper deflecting means 12 is also termed the conveying region or forward running region of the conveying device 1 in the following, since in this region the tread surfaces 9 of the steps 2 face upwardly and thus can accept and convey persons. The return guidance of the steps 2 from the upper deflecting means 12 to the lower deflecting means 13 takes place in a return guidance region which is here termed the return running region 11. This return running region 11 is disposed below the mentioned forward running region. During the return guidance, i.e. in the return running region 11, the steps 2 with the tread surfaces 9 "hang" downwardly.

Figure 2:
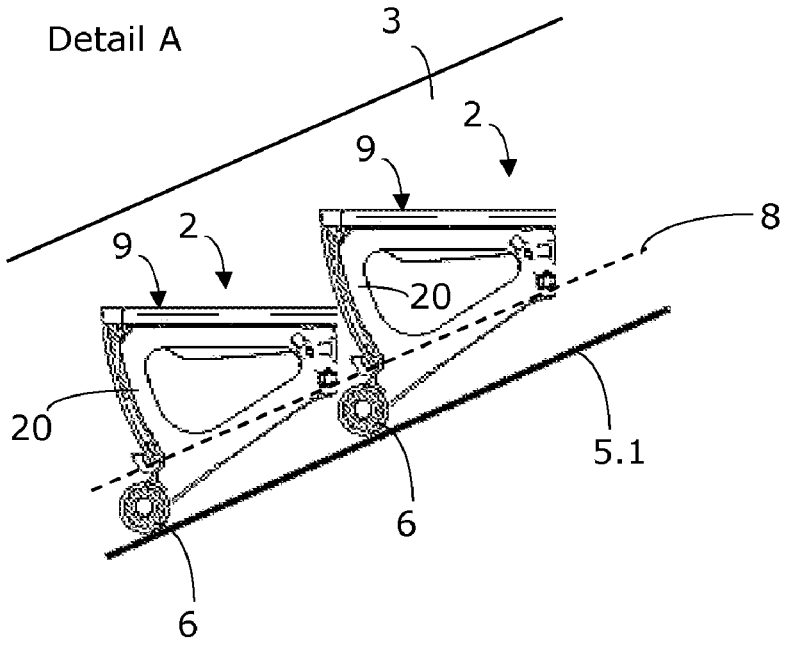
FIG. 2 shows a part region A of the conveying device according to FIG. 1 in an enlarged view.

According to a first form of embodiment of the invention, which is shown in more detail in FIG. 2, use is now made of steps 2 which comprise, instead of the usual step cheeks, deep-drawn step cheeks 20 with drag or guide rollers 6 fastened thereto. These rollers 6 are mechanically connected with the respective step cheeks 20 and so constructed that in the forward running region they travel or roll along a first guide rail 5.1 when the endless conveyor of the conveying device 1 is in motion, as can be seen in FIG. 2. The first guide rails 5.1 are, in the present connection, also termed forward running guide rails so as to emphasise the function thereof. The course or position of the step chain with the chain rollers (not shown in FIG. 2) disposed thereat is only indicated, by the line 8, in FIG. 2.

Figure 3A:
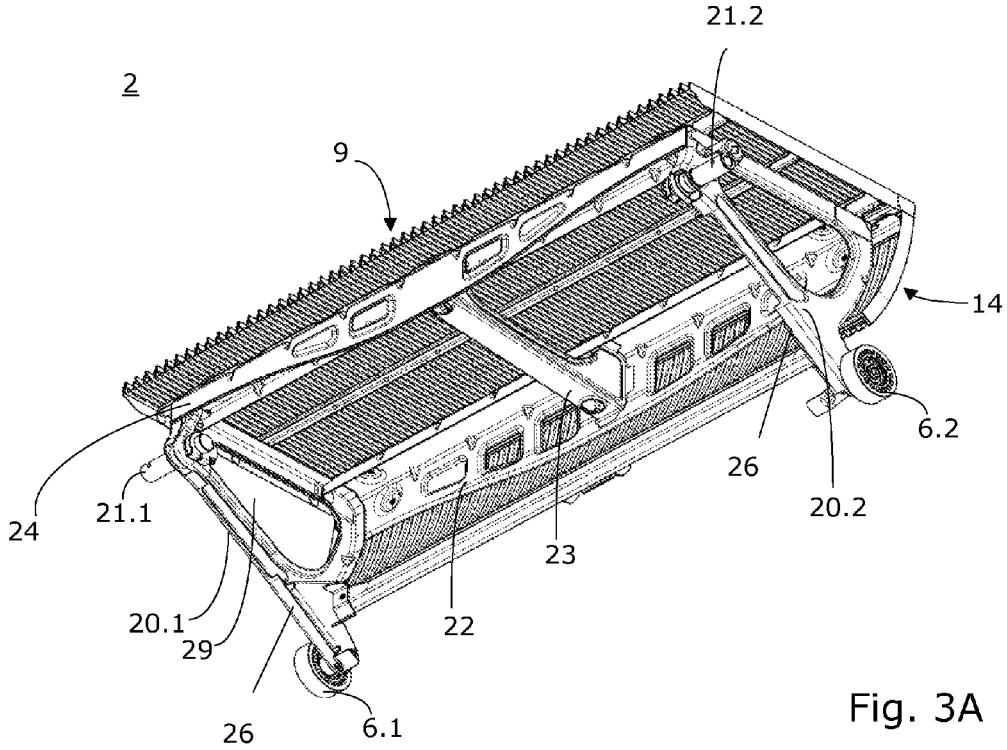
FIG. 3A shows a perspective view of a complete step with two step cheeks according to the invention, from below.

Further details and specifics of the invention are now described in connection with the following figures. A perspective view of a complete step 2 with two step cheeks 20.1, 20.2 according to the invention is illustrated in FIG. 3A. As seen in the travel direction, when the steps 2 move from the level E1 to the level E2 the step cheek 20.1 is arranged on the right and the step cheek 20.2 on the left of the tread element 9. Each step cheek 20.1, 20.2 has a drag roller 6.1, 6.2 and a chain axle 21.1, 21.2. At least one central recess 29, or passage, is present in the step cheek 20.1 or 20.2. In addition, each step cheek 20.1 or 20.2 has a sheet metal flange 26, sheet metal collar, sheet metal wall or sheet metal edge which was formed during the deep-drawing. This sheet metal flange 26 extends substantially perpendicularly to the surface of the step cheek 20.1 as well as to the step cheek 20.2. The sheet metal flange 26 does not necessarily have to run around the entire step cheek 20.1 or 20.2. It can also be present only partly or only in sections. The encircling sheet metal flange 26 can be seen clearly in FIGS. 4B and 5D.

Further details of the support of a step 2 can be seen in FIG. 3A. The support also comprises, for example—apart from the mentioned step cheeks 20.1 and 20.2—a rear cross member 22, a front cross member 24 and a centre longitudinal member 23 (middle member or centre member). These members 22, 23, 24 can also be made from deep-drawn sheet metal. The members and the step cheeks together form the support of the step or the so-termed support structure or support frame.

The tread element 9 and the riser element 14 are fastened at or on the support.

Figure 3B:
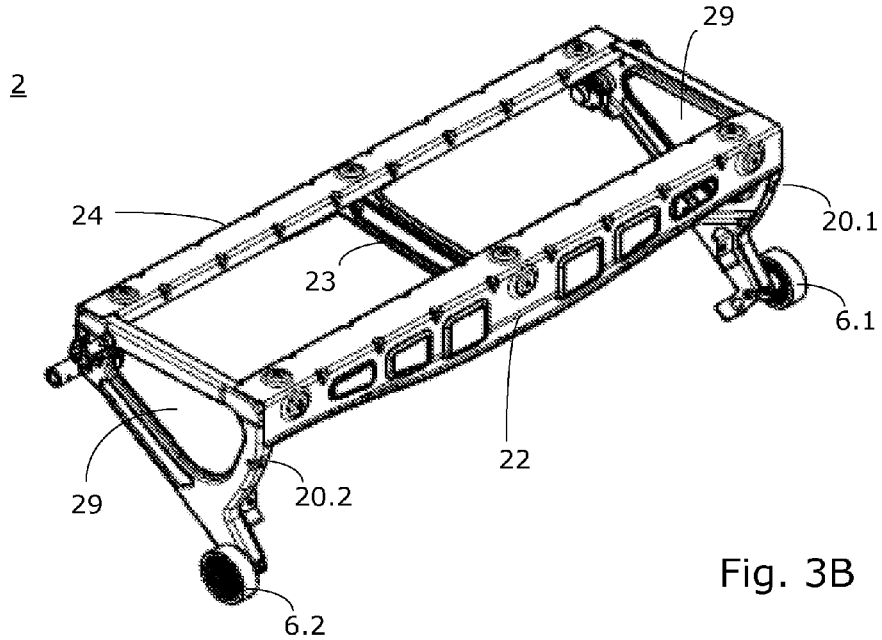
FIG. 3B shows a perspective view of the support of a step with two step cheeks according to the invention, from above.

Further details of the support or the support structure can be seen in FIG. 3B. The members 22, 23, 24 and the step cheeks 20.1, 20.2 are welded, riveted, connected, screw-connected, glued or clinched together. Spot welding is preferably undertaken in order to connect these elements with one another. Another advantage of the invention is evident here: since the step cheeks 20.1, 20.2 are made of sheet metal, steel sheet, stainless steel sheet, zinc sheet or copper sheet they can be welded, riveted, connected, screw-connected, glued or clinched to other sheet metal elements (for example the members 22, 24 or an edge plate 27, 34) without problems. The welding of aluminium elements, thereagainst, is costly and involved as well as time-consuming.

Figure 4A:
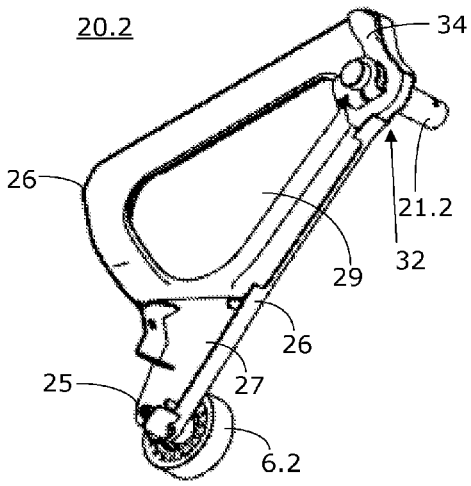
FIG. 4A shows a perspective view of a step cheek according to the invention, from the inside.
Figure 4B:
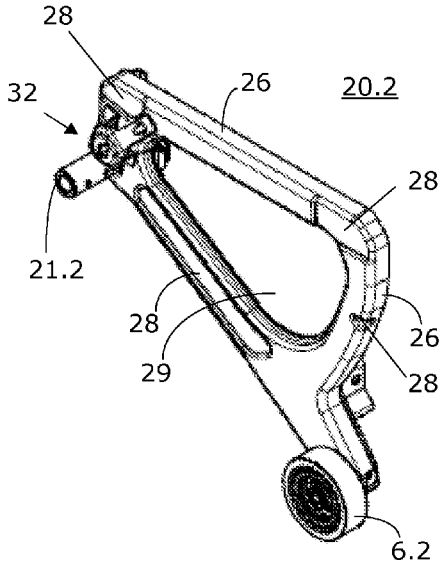
FIG. 4B shows a perspective view of a step cheek according to the invention, from the outside.

Further details of a lefthand step cheek 20.2 can be seen in FIGS. 4A and 4B. The step cheek 20.2 is 'fitted' with all elements and can be incorporated or welded in place in the shown form in the step support. It can be seen that a chain pin axle 21.2 or chain roller axle 21.2 is inserted or plugged in place in the region of a step eye 32 (also termed a chain pin eye). A slide bearing bush (not able to be seen in the figures) can be pressed into the step eye 32 so as to then receive the chain pin axle 21.2. The chain pin axle or chain roller axle 21.2 is preferably a plug axle. The plug axle can be constructed with a calibrated receiving bore. The chain roller axle or chain pin axle serves as entrainer or coupling for the step or plate to the chain or conveying chain (not shown).

The step eye 32 is entirely defined by the deep-drawn sheet metal, steel sheet or stainless steel sheet. The step eye is fully, exactly and completely constructed by the deep-drawing process from metal sheet. An additional component is not required. Furthermore, the step eye of the step cheek is enclosed or surrounded by the sheet metal.

Moreover, the step cheek 20.2 has a drag roller eye 30. Here, too, a slide bearing bush can be pressed in place (not able to be seen in the figures) in order to then accept a drag roller axle 25 or a roller pin. The drag roller axle 25 or the roller pin can be secured by a nut or welded in place or secured by weld seams. The drag roller axle 25 or the roller pin is preferably a plug axle or a plug pin. The drag roller axle 25 or the roller pin serves as an axle for the drag roller 6.2.

Figure 5A:
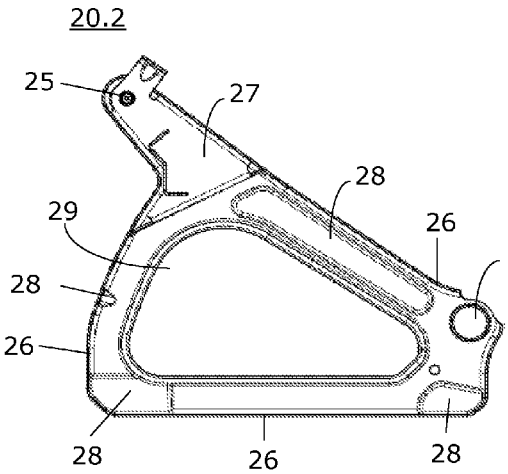
FIG. 5A shows a side view of the deep-drawn sheet metal of a step cheek according to the invention, from the inside.
Figure 5B:
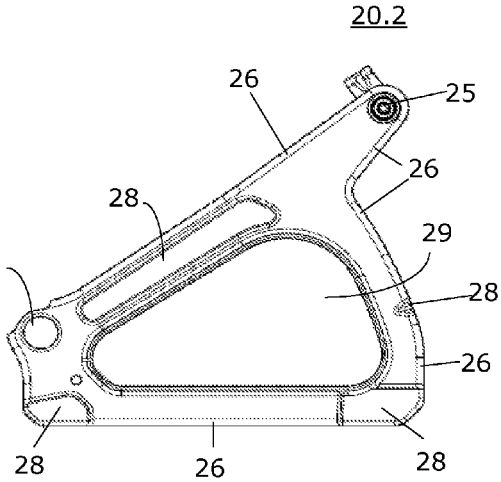
FIG. 5B shows a side view of the deep-drawn sheet metal of a step cheek according to the invention, from the outside.
Figure 5C:
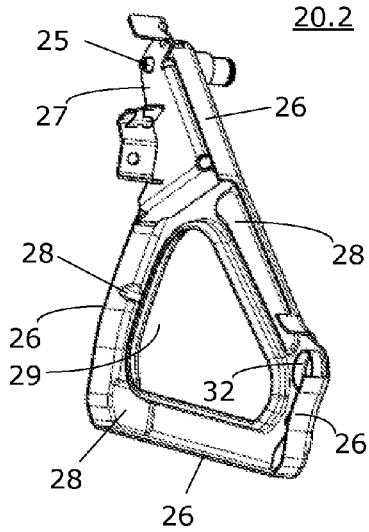
Figure 5D:
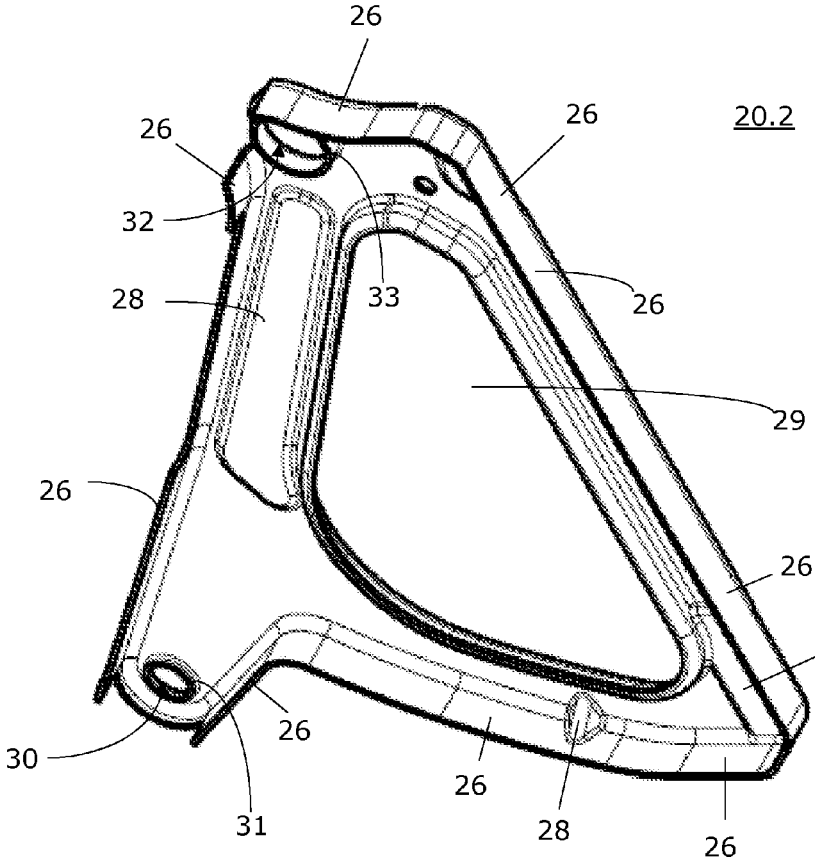
FIG. 5D shows an enlarged perspective view of the deep-drawn sheet metal of a step cheek according to the invention, from the inside.

The drag roller eye 30 is preferably also entirely defined by the deep-drawn sheet metal or it is entirely surrounded or enclosed by the sheet metal, as can be seen in, for example, FIG. 5D.

In the region of the drag roller eye 30 the step cheek 20.2 can be stiffened, supported or covered from the inside by a closure plate 27. This closure plate 27 (also termed a 1st closure plate) can be welded in place in a cavity or hollow part or hollow web or step (cheek) post, which arises through the deep-drawing. A similar, 2nd closure plate 34 can be provided in the region of the step eye 32 (see FIG. 4A). The 2nd closure plate 34 can be constructed or formed as an additional bearing receptacle.

Further details or specifics of a step cheek 20.2 according to the invention are shown in FIGS. 5A to 5D. As can be seen, the deep-drawn sheet metal is provided with the recess or passage 29. This recess is preferably produced, after the deep-drawing, by cutting or punching the sheet metal. In addition, the stated eyes 30 and 32 can be pre-punched before they receive an encircling sheet metal collar 31 or 33 by the deep-drawing. The so-termed eyes 30 and 32 are preferably produced, after the deep-drawing, by cutting, trimming or aperturing. Processing after the deep-drawing has the advantage of uniform collar thickness. This means that the eyes have or the eye has a uniform rest, bearing rest, bearing length, bearing depth or bearing width and uniform wall size or wall thickness as well as precise centricity. The encircling sheet metal collars 31 and 33 facilitate stable installation of the slide bush or slide bushes for the respective axles 21.2 and 21.1 or for the pin 25 or for the drag roller axle.

Moreover, sufficient stability is imparted to the step cheek in that additional shaped portions 28 and additional corrugations 28 are present. The sheet metal flange 26 also imparts a very high or very substantial stability to the thin deep-drawn sheet metal.

Use is preferably made of H380 or H400 deep-draw sheet metal or sheet metal, wherein the numbers 380 and 400 indicate the yield point in $N/mm^2$. These sheet metals are particularly suitable, because a yield point in tension of at least 900 $N/mm^2$ is given. Beyond that, it is particularly advantageous if the sheet metals have a yield point in tension of at least 1100 $N/mm^2$.

The deep-draw sheet metal used preferably has a thickness between 0.9 millimeters and 1.9 millimeters. A thickness of 1.5 to 1.8 millimeters is particularly preferred.

If the deep-drawn sheet metal is selected in correspondence with the above specifications, then the step cheeks or the step or steps fulfils or fulfil all load tests of Standard EN 115: Safety Regulations for the Construction and Installation of Escalators and Moving Walkways, as well as AN—American National Standard—ASME A17.1-2004: Safety Code for Elevators and Escalators.

The deep-drawn sheet metal preferably has a surface coating. Surface coatings produced by dip-coating are particularly preferred.

Electrolytic dip-coating (EDC) is particularly suitable.

The result of EDC is a very uniform coating of the deep-drawn sheet metal with uniform layer thickness and good surface qualities. After the EDC treatment the deep-drawn sheet metal has a uniform, continuous coating layer. Particularly good results are achieved if the EDC treatment is used after deep-drawing of the sheet metal.

Use of the EDC treatment prior to the deep drawing is also conceivable. Moreover, use or employment with (pre-) galvanised sheet metals or stainless steel sheets or copper sheets is also possible.

As described, the invention can be used on escalators and moving walkways.

The invention claimed is:

1. A step or plate construction for a conveying device, comprising two lateral cheeks each substantially perpendicular to both a tread element and a riser element of the construction, each cheek comprising an integral deep-drawn metal sheet of a three-dimensional form with an at least partly encircling flange, a chain pin axle for a chain, at least one deep drawn eye for the chain pin axle enclosed or surrounded by the metal sheet, and an encircling sheet metal collar in a region of at least one eye.

2. A construction according to claim 1, wherein the chain pin axle is a chain pin plug axle.

3. A construction according to claim 1 or 2, wherein the chain pin axle is not continuous over an entire width of the conveying device.

4. A construction according to claim 1 or 2, further comprising at least one drag roller axle and at least one drag roller, wherein the drag roller axle is inserted in at least one drag roller eye.

5. A construction according to claim 4, wherein the drag roller axle is formed as a molded or turned part.

6. A construction according to claim 4, further comprising an encircling sheet metal collar at the metal sheet in a region of the drag roller eye.

7. A construction according to claim 1 or 2, further comprising at least one edge plate attached to the metal sheet, wherein the edge plate together with a region of the metal sheet encloses a receiving region for at least one axle.

8. A construction according to claim 7, wherein the edge plate is attached to the metal sheet by at one of a group consisting of weld seams, weld points, clinch points, glue surfaces, self-tapping screws, flow-hole-forming screws and drill-tip screws.

9. A construction according to claim 1 or 2, wherein the metal sheet is an H380 or H400 fine steel sheet.

10. A construction according to claim 1 or 2, wherein the metal sheet is chosen from the group consisting of stainless steel, copper, and surface coated metal sheets produced by electrolytic dip-coating, pre-galvanizing or hot-dip galvanizing.

11. A construction according to claim 1 or 2, wherein the metal sheet has a thickness between 1.0 millimeters and 1.9 millimeters.

12. A construction according to claim 1 or 2, wherein the metal sheet has at least one of a corrugation or passage.

* * * * *